United States Patent [19]

Bly

[11] Patent Number: 4,645,154

[45] Date of Patent: Feb. 24, 1987

[54] RETAINING CLIP FOR PEG BOARD HOOK

[76] Inventor: Herbert A. Bly, 10 Shadowstone La., Lawrenceville, N.J. 08648

[21] Appl. No.: 721,687

[22] Filed: Apr. 10, 1985

[51] Int. Cl.[4] ..... E04G 3/00

[52] U.S. Cl. ..... 248/220.4; 248/221.4

[58] Field of Search ..... 248/220.4, 220.3, 221.1, 248/221.2, 221.4

[56] References Cited

U.S. PATENT DOCUMENTS

| | | | |
|---|---|---|---|
| 3,154,281 | 10/1964 | Frank | 248/221.4 X |
| 3,501,117 | 3/1970 | Soltysik | 248/221.4 X |
| 3,650,502 | 3/1972 | Langhi | 248/220.4 |
| 4,304,382 | 12/1981 | Jelen | 248/221.1 |
| 4,441,680 | 4/1984 | Riukin et al. | 248/220.4 |

FOREIGN PATENT DOCUMENTS

| | | | |
|---|---|---|---|
| 2610446 | 9/1977 | Fed. Rep. of Germany | 248/220.4 |

*Primary Examiner*—J. Franklin Foss
*Assistant Examiner*—David L. Talbott
*Attorney, Agent, or Firm*—Richard C. Woodbridge

[57] ABSTRACT

A retaining clip for use with a variety of wire hooks and other forms of hangers used to store or display tools, merchandise, and other objects on perforated composition panel board commonly known as peg board. The retaining clip is formed of semi-elastic material and consists of a central portion grooved to fit over the shank of conventional peg board hooks, with two arms projecting outward on opposite sides of the central groove, each with barbed prongs positioned to be inserted into adjacent perforations in the peg board and to be locked or retained therein by the barbs, thus preventing movement of the hook and accidental detachment. The retaining clip may be used with peg board of various thicknesses by elongating the prongs to fit the maximum thickness of peg board to be accommodated, and inclining the projecting arms at an angle great enough, when the retaining clip is under zero stress, that the distance from the barbs to the base of the center goove, measured parallel to the centerline of the retaining clip, is less than the minimum thickness of peg board to be accommodated.

2 Claims, 5 Drawing Figures

RETAINING CLIP FOR PEG BOARD HOOK

SUMMARY OF THE INVENTION

A Retaining Clip for use with a variety of wire hooks and other forms of hangers commonly used in conjunction with standard perforated composition board, commonly known as peg board, for suspending or displaying tools, blister packs, envelopes, merchandise and the like. Said Retaining Clip is provided with a semi-circular groove which fits tightly over the shank of the wire hook, with two projecting arms and barbed prongs which fit into adjacent perforations in the peg board, and are locked or retained therein by the barbs. The object of the invention is to prevent movement of the hook as well as accidental disengagement of the hook from the peg board. The Retaining Clip is semi-elastic and the projecting arms are inclined at an angle so that an inward retaining force is applied to the hook when used with different thicknesses of peg board.

DRAWINGS

DETAILED DESCRIPTION

Figure 1:
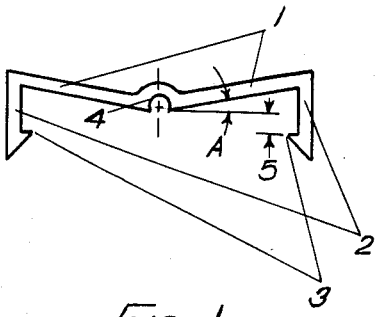
FIG. 1 is a top view of the Retaining Clip.

Perforated composition panel board, commonly known as peg board, is used in conjunction with a variety of shapes and sizes of wire hooks, loops and other hanger shapes to store or display tools, blister packs, envelopes, cards and a wide variety of other objects. A universal problem with conventional peg board hooks is their looseness and tendency to detach and fall when an object is placed on, or removed from, the hook. The S-shaped end of the hook, inserted into a peg board hole, is the primary means of retaining the hook in position. A slight upward, lateral or rotational force on the hook will often cause the S-shaped end of the hook to slip out of the peg board hole, and the hook to disengage and fall. Attempts have been made to remedy this problem by welding a projecting pin or lug on the rear portion of the hook spaced below the S-shaped end so that it can be inserted into the next lower peg board hole. This is intended to provide lateral stability and reduce the tendency to detach. However, the pin or lug soon becomes loose in the hole and is ineffective in preventing upward pivoting and detachment of the hook. My invention consists of a Retaining Clip with a central groove or socket which fits tightly over the shank of the wire hook, and two projecting arms with barbed prongs which are inserted and lock into the two adjacent perforations in the peg board, preventing the wire hook from moving in any direction, facilitating use of the hook and effectively preventing it from accidentally becoming detached.

Referring now to the drawings:

FIG. 1 is a top view of the Retaining Clip showing the projecting arms 1, the prongs 2 with barbs 3 and semi-circular groove 4 in a relaxed, non-stressed state.

Figure 2:
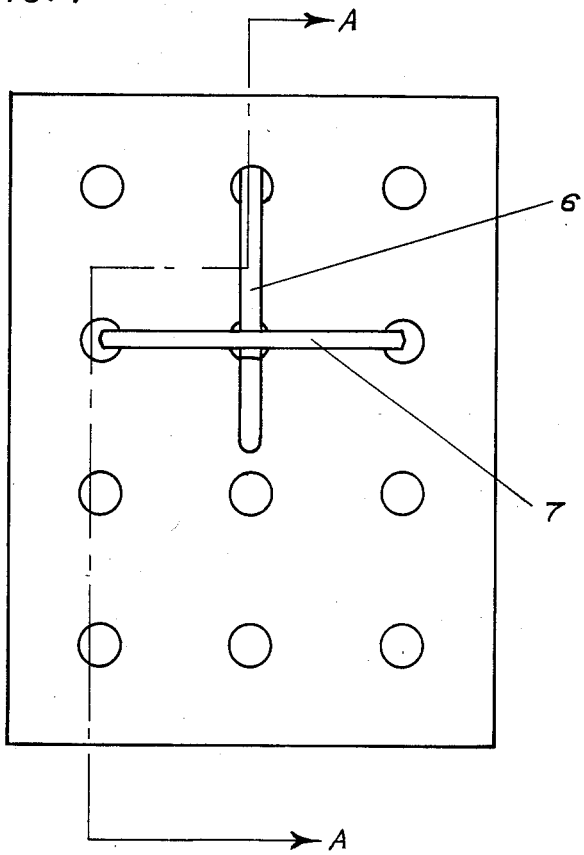
FIG. 2 is a front view of a panel of peg board with a wire hook and Retaining Clip installed.

FIG. 2 is a front view of a panel of perforated peg board with a conventional wire hook 6 and Retaining Clip 7 installed.

Figure 3:
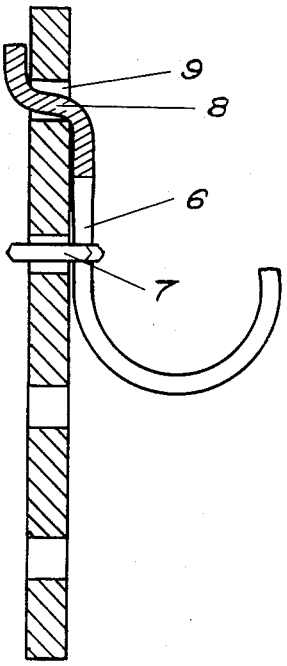
FIG. 3 is a side section view of the wire hook and Retaining Clip installed in maximum thickness peg board.

FIG. 3 is a side section view of the wire hook and Retaining Clip, designated Section A—A in FIG. 1. The S-shaped end 8 of the hook 6 is shown inserted in the peg board hole 9, with the Retaining Clip 7 installed.

Figure 4:
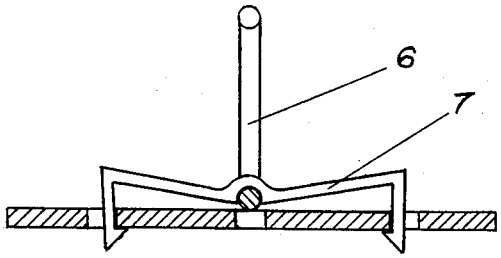
FIG. 4 is a top section view of the wire hook and Retaining Clip installed in minimum thickness peg board.

FIG. 4 is a top section view of the wire hook 6 with Retaining Clip 7 installed in $\frac{1}{8}''$ thick standard composition peg board.

Figure 5:
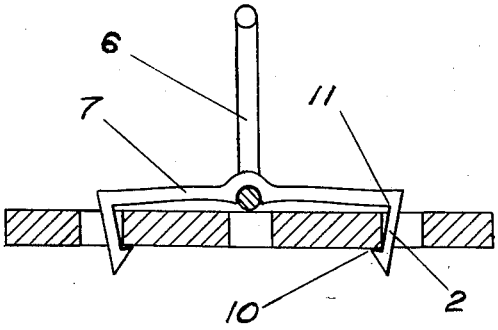
FIG. 5 is a top section view of the wire hook and Retaining Clip installed in maximum thickness peg board.

FIG. 5 is a top section view of the wire hook 6 with Retaining Clip 7 installed in $\frac{1}{4}''$ thick standard composition peg board.

The Retaining Clip is formed of semi-elastic material such as polypropylene which permits substantial elastic deformation without fracture. Referring now to FIG. 5, to allow use with different thicknesses of peg board, the prongs, 2, are sized so that the distance from the lip of the barb 10 to the intersection of the inside surface of the prong and projecting arm 11 is at least equal to the maximum peg board thickness to be accomodated. When used on thinner peg board, as shown in FIG. 4, the angle of inclination of the projecting arms, FIG. 1; Angle A, compensates for the difference in thickness, and the semi-elastic Retaining Clip exerts inward force on the wire hook in all cases.

Said inclination angle must be great enough when the Retaining Clip is in its relaxed state under no stress, that the distance from the lips of the barbs to the base of the groove, FIG. 1; 5, measured parallel to the centerline of the Retaining Clip, is less than the minimum thickness of peg board to be accomodated, to insure that elastic deformation will result in an inward force applied to the hook when installed in peg board.

The barbs on the prongs, FIG. 1; 3, are tapered toward the center of the peg board holes to align the prongs and facilitate insertion in the holes. It is important to note that downward elastic deflection of the projecting arms during insertion of the prongs in the peg board holes, results in a decrease in the distance between the barbs on the opposite prongs, thus increasing the secure grip and pressure of the barbs on the inner sides of the peg board holes. Also, any outward force on the wire hook tends to increase pressure of the barbs on the inner sides of the peg board holes.

A further advantage of the Retaining Clip is that it eliminates the need for pins or lugs welded to the rear portion of the wire hooks to prevent lateral movement, resulting in a significant cost reduction in manufacturing. However, the Retaining Clip may be used with such hooks, even though the pins or lugs may not permit the hook to lie flush against the peg board, since the Retaining Clip will compensate for substantial variation in hook spacing from the peg board surface due to the inclination of the projecting arms.

I claim:

1. A retaining clip apparatus for holding hooks against a pegboard having holes therein, said apparatus comprising:

a central portion including a semi-circular groove therein for at least partially surrounding the shank of a pegboard hook;

a pair of resilient projecting arms attached to opposite sides of said central portion;

a pair of prongs attached respectively to the ends of said projecting arms not connected to said central portion;

barb means attached to the unattached end of said prongs and located on said prongs such that said barb means face towards each other, said barb means having a lip thereon for engaging the surface of said pegboard opposite from the surface against which the shank of said hook lies such that the distance from the lips on said barb means to the intersection of the inside surface of said prongs and said projecting arms is at least equal to the maximum thickness of pegboard to be accomodated, said barb means being tapered towards the center of said pegboard holes into which said prongs are to be inserted in order to align said prongs; and, means for increasing the grip of said barb means in proportion to the increase in the size of the shank of said hook to be retained, said means for increasing the grip of said barb means including providing an angle of inclination between said projecting arms such that the distance from the lips of said barb means to the base of said semi-circular groove measured parallel to the center line of said retaining clip when said retaining clip is in its relaxed state is less than the minimum thickness of the pegboard to be accomodated in order to insure that elastic deformation will result in a net force applied to the shank of said hook against said pegboard, said clip being formed from a semi-elastic material.

2. The apparatus of claim 1 wherein said clip has a generally "M" shaped profile.

* * * * *